US009929501B2

(12) United States Patent
Hannawa et al.

(10) Patent No.: US 9,929,501 B2
(45) Date of Patent: Mar. 27, 2018

(54) ELECTRICAL CONNECTOR

(71) Applicant: RW INTERNATIONAL, LLC, Warren, MI (US)

(72) Inventors: Wael M. Hannawa, West Bloomfield, MI (US); Ramize Sheena, West Bloomfield, MI (US)

( * ) Notice: Subject to any disclaimer, the term of this patent is extended or adjusted under 35 U.S.C. 154(b) by 0 days.

(21) Appl. No.: 15/011,847

(22) Filed: Feb. 1, 2016

(65) Prior Publication Data

US 2016/0226188 A1 Aug. 4, 2016

Related U.S. Application Data

(60) Provisional application No. 62/109,655, filed on Jan. 30, 2015.

(51) Int. Cl.
*H01R 13/627* (2006.01)
*H01R 13/621* (2006.01)

(52) U.S. Cl.
CPC ..... *H01R 13/6272* (2013.01); *H01R 13/6215* (2013.01); *H01R 13/6275* (2013.01)

(58) Field of Classification Search
CPC ..... H01R 13/6215; H01R 13/6395; H01R 13/6275; H01R 13/6272; H01R 13/6273; H01R 13/631; H01R 13/562
USPC ..... 439/359, 357, 358, 374, 468, 445, 478
See application file for complete search history.

(56) References Cited

U.S. PATENT DOCUMENTS 5,997,361 A * 12/1999 Driscoll ..... H01R 13/6599 439/358
6,612,860 B2 * 9/2003 Droesbeke ..... H01R 13/6275 439/352
6,786,747 B1 * 9/2004 Kamath ..... H01R 13/6273 439/188
7,371,102 B2 * 5/2008 Sakamoto ..... H01R 13/6275 439/352
7,431,605 B2 * 10/2008 Dieterle ..... H01R 13/6272 439/358

* cited by examiner

*Primary Examiner* — Hien Vu
(74) *Attorney, Agent, or Firm* — Avery N. Goldstein; Blue Filament Law, PLLC

(57) ABSTRACT

A wiring feedthrough assembly is provided that has a set of parallel guide rails with slots with a female electrical connector positioned between the guide rails that join to a feedthrough connector with a male electrical connector. A set of wings on opposite sides of the feedthrough connector are configured to engage and slide in the slots until the female electrical connector engages the male electrical connector. A conduit extending outward from the feedthrough connector contains a set of wires, where the set of wires terminate at the male electrical connector. The wiring feedthrough assembly provides for more reliable connections that are easier to install and remove in applications such as display cases, including refrigeration applications.

5 Claims, 6 Drawing Sheets

ELECTRICAL CONNECTOR

CROSS REFERENCE TO RELATED APPLICATIONS

This application claims priority benefit of U.S. Provisional Application Ser. No. 62/109,655 filed 30 Jan. 2015; the contents of which are hereby incorporated by reference.

FIELD OF THE INVENTION

The present invention in general relates to the field of electrical components and in particular to a connector assembly suitable for use in display cases.

BACKGROUND OF THE INVENTION

Commercial refrigerators and refrigerated display cases (coolers and freezers) are used in markets, food-vending operations, liquor stores for the preservation of freshness and attractive display of product to the customer. Typically, commercial display cases have frames defining a rectangular opening for the case which is accessed through sliding doors or swing doors having large areas of multi-layered glazing to permit the customer to see, select and access the refrigerated product easily, while preventing heat transfer into the refrigerated space. The display case frame includes an upper frame member, a lower frame member, two laterally spaced side frame members extending vertically between the upper and the lower frame members, and one or more mullions which extend vertically between the upper frame member and the lower frame member and connected thereto. The mullion provides support for the cabinet frame, associated doors, and also provides a sealing surface against which portions of the door assemblies engage and seal for effective sealing of the refrigerated cabinet. Typically, mullions are also equipped with electrical conduits for delivering electrical power to anti-condensation devices for the door assemblies and for a fluorescent lighting fixture associated with the mullion.

FIGS. 1A-1D are views of an existing wiring feedthrough used in commercial refrigerators and refrigerated display cases that connects to the electrical conduits in the mullion for delivering electrical power to anti-condensation devices for the door assemblies and for a lighting fixture associated with the mullion. While the feedthrough connector shown in FIGS. 1A-1D is widely used the construction which relies on connector pins makes these connectors hard to install and remove, and are prone to dislodge or break over time.

Thus, there exists a need an improved electrical feedthrough connector that provides a more reliable connection for display cases, including refrigeration applications.

SUMMARY OF THE INVENTION

A wiring feedthrough assembly has a set of parallel guide rails with slots with a female electrical connector positioned between the guide rails that join to a feedthrough connector with a male electrical connector. A set of wings on opposite sides of the feedthrough connector are configured to engage and slide in the slots until the female electrical connector engages the male electrical connector. A conduit extending outward from the feedthrough connector contains a set of wires, where the set of wires terminate at the male electrical connector.

BRIEF DESCRIPTION OF THE DRAWINGS

The present invention is further detailed with respect to the following drawings, where like numerals have the same meaning imparted thereto in the various drawings. These figures are not intended to limit the scope of the present invention but rather illustrate certain attributes thereof.

DETAILED DESCRIPTION OF THE INVENTION

The present invention has utility as a wiring feedthrough assembly that provides for more reliable connections that are easier to install and remove in applications such as display cases, including refrigeration applications. In a specific embodiment, the wiring feedthrough assembly connects to an electrical conduit in a mullion for delivering electrical power to an anti-condensation device for a door assembly and for a lighting fixture associated with the mullion in a refrigeration unit.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Figure 1A:
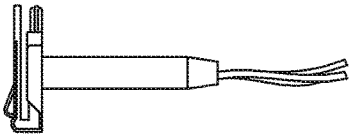
FIG. 1A (PRIOR ART)
FIGS. 1A-1D are perspective views of an existing wiring feedthrough assembly.
Figure 1B:
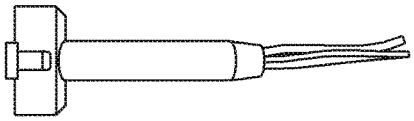
FIG. 1B (PRIOR ART)
Figure 1C:
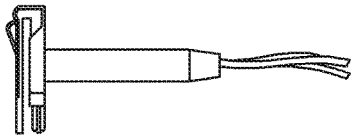
FIG. 1C (PRIOR ART)
Figure 1D:
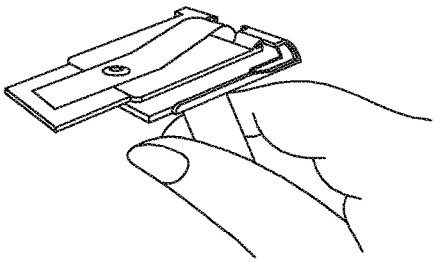
FIG. 1D (PRIOR ART)
Figure 2A:
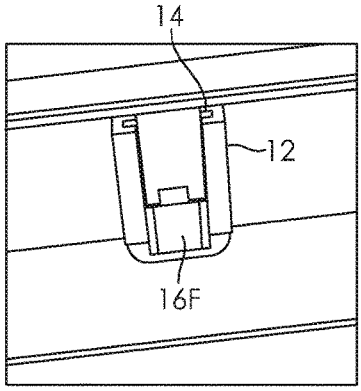
FIGS. 2A-2H are perspective views of a wiring feedthrough assembly with a mating sliding guide with a securement screw according to an embodiment of the invention.
Figure 2B:
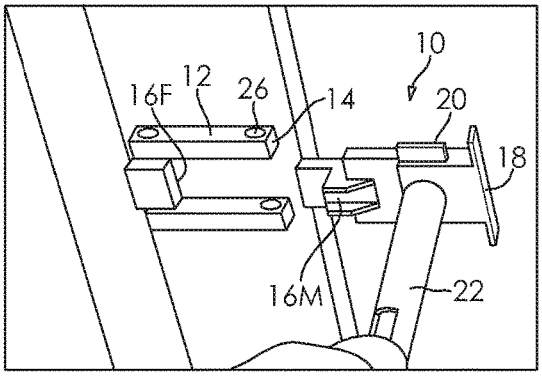
Figure 2C:
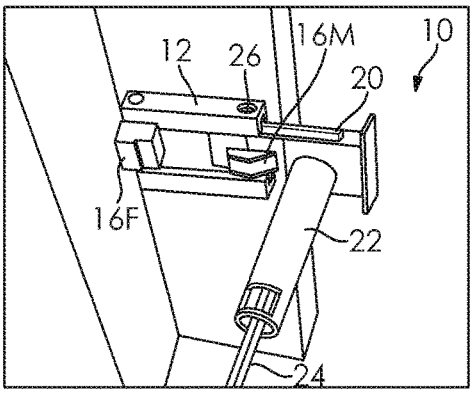
Figure 2D:
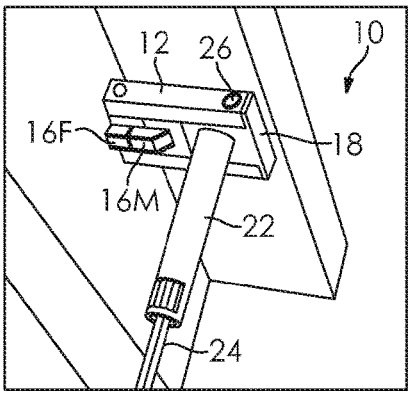
Figure 2E:
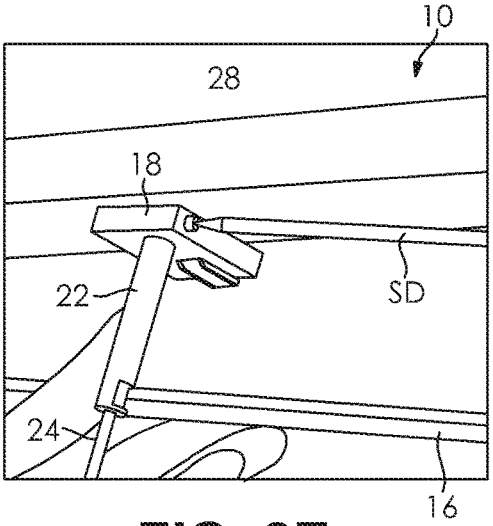
Figure 2F:
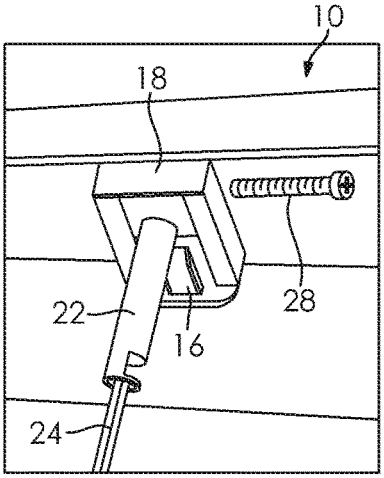
Figure 2G:
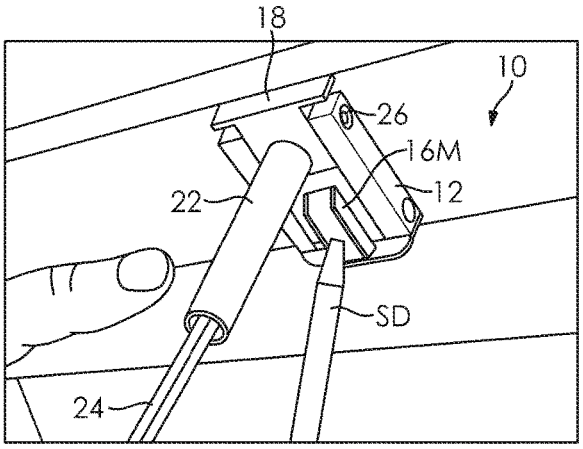
Figure 2H:
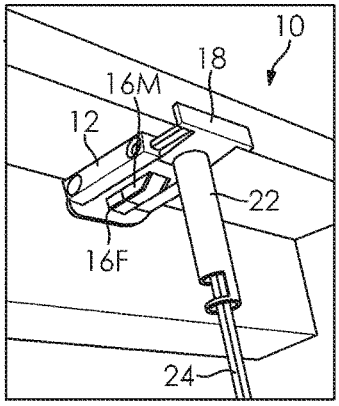

With reference to the attached figures, an inventive wiring feedthrough connector assembly is depicted generally at 10 in FIGS. 2A-2H. FIG. 2A shows a set of parallel female sliding guide rails 12 with slots 14, and a female snap electrical connector 16F with connection ports for each of the wires to be routed. The guide rails 12 with slots 14 are configured to align the feedthrough connector 18 and the male portion of the snap electrical connector 16M to the female snap electrical connector 16F as shown in FIGS. 2B and 2C. The feedthrough connector 18 has wings 20 that are configured to slide into the slots 14 of the guide rails 12. A feedthrough conduit 22 extends outward to protect a bundle of wires 24 that terminate at the male portion of the snap electrical connector 16M. The guide rails 12 are further configured with a threaded hole 26 (see FIGS. 2B-2D) that accommodates a screw 28 (shown in FIGS. 2E and 2F with screw driver SD) or a spring loaded pin 90 (FIG. 7) that secures the feedthrough connector 18 when the feedthrough connector 18 is fully engaged and inserted in the rails 12, and the male (16M) and female (16F) connector are joined to form snap electrical connection 16. FIGS. 2E-2F show the simplicity with which the wiring feedthrough connector assembly 10 is separated. A screw driver SD removes the securement screw 28, and is then used to apply downward pressure on the snap electrical connector 16 to separate back into the male (16M) and female (16F) sub-connectors as shown in FIG. 2G. FIG. 2H shows the feedthrough connector 18 being separated from the guide rails 12.

Figure 3A:
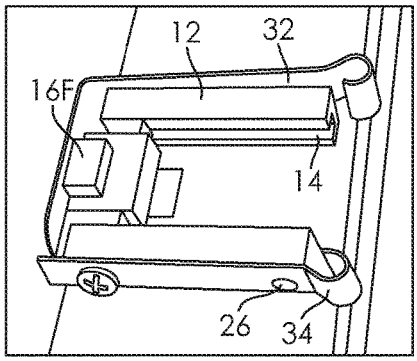
FIGS. 3A and 3B are perspective views of a wiring feedthrough assembly with a mating sliding guide rail configured with side clip hooks according to an embodiment of the invention.
Figure 3B:
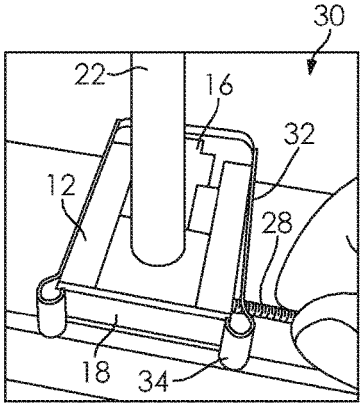

FIGS. 3A and 3B are perspective views of a wiring feedthrough assembly 30 with a mating sliding guide rail 12 configured with side clips 32 with hooks 34 according to an embodiment of the invention. In FIG. 3B, with the feedthrough connector 18 fully engaged and inserted in the rails 12, the side clips 32 which have an inward spring like bias that cause the hooks 34 to secure the feedthrough connector 18. A pin or screw 28 can also be added to further secure the feedthrough connector 18.

Figure 4A:
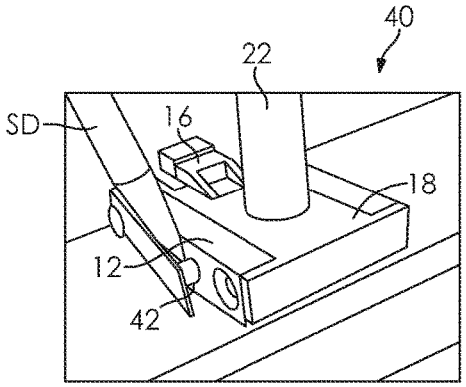
FIGS. 4A and 4B are perspective views of a wiring feedthrough assembly with a mating sliding guide rail configured with side clip locking engagement pins according to an embodiment of the invention.
Figure 4B:
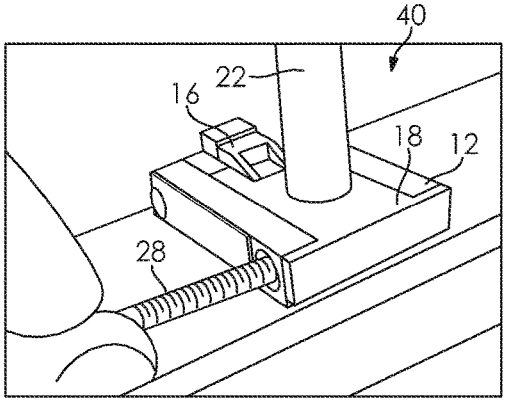
Figure 5A:
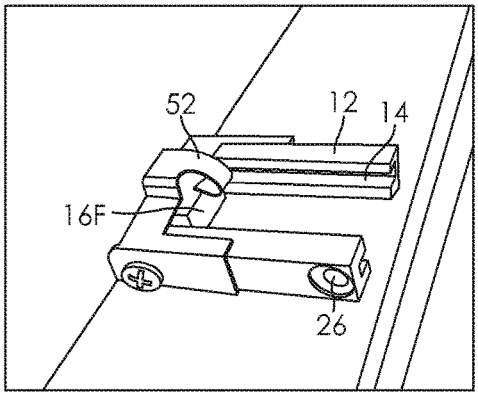
FIGS. 5A-5D are perspective views of a wiring feedthrough assembly with a mating sliding guide rail configured with a J-hook for engagement according to an embodiment of the invention.
Figure 5B:
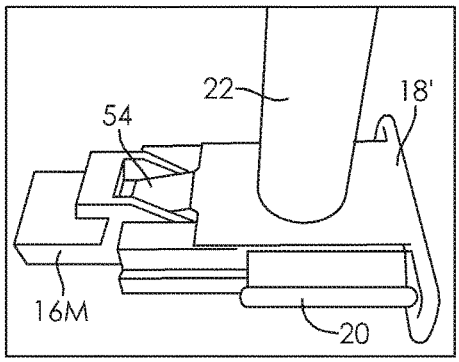
Figure 5C:
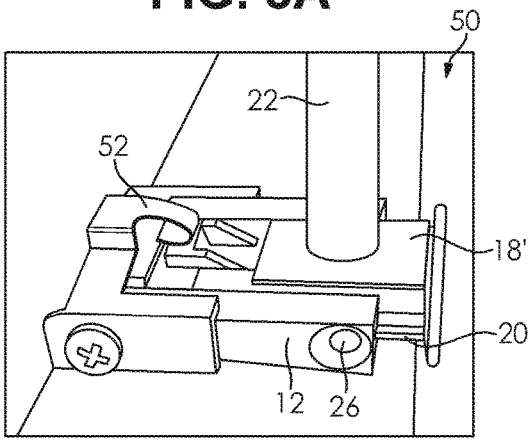
Figure 5D:
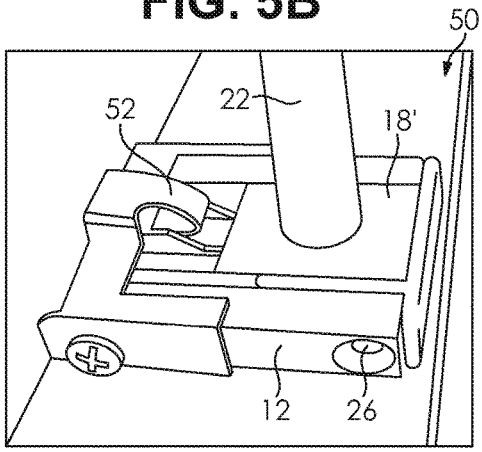

FIGS. 4A and 4B are perspective views of a wiring feedthrough assembly 40 with a mating sliding guide rail 12 configured with a side clip locking engagement pin 42 according to an embodiment of the invention. In FIG. 4A, in order to insert the feedthrough connector 18, the side clip locking engagement pin 42 is extended away from the rail 12 by prying with a screwdriver SD. In FIG. 4B with the feedthrough connector 18 fully engaged in the rail 12, the side clip locking engagement pin 42 is allowed to retract and catches the rear edge of the wing 20 in the slot 14. A pin or screw 28 may also be inserted.

FIGS. 5A-5D are perspective views of a wiring feedthrough assembly 50 with a mating sliding guide rail 12 configured with a J-hook 52 for engagement with a complementary bend 54 on the feedthrough connector 18' according to an embodiment of the invention. When the feedthrough connector 18' is fully inserted in guide rail 18', the J-hook 52 engages the bend 54 on the feedthrough connector 18', as shown in FIG. 51).

Figure 6A:
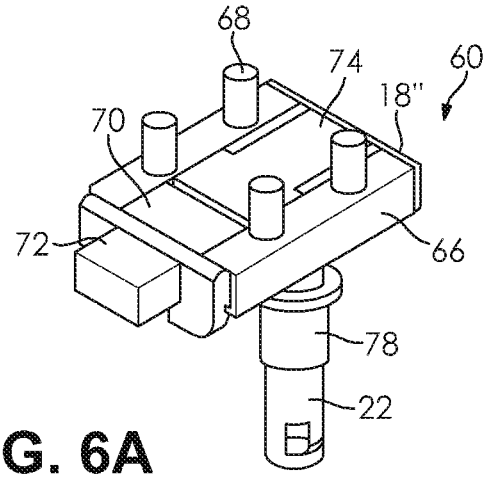
FIGS. 6A-6E are perspective and exploded views of a wiring feedthrough and connector assembly according to an embodiment of the invention.
Figure 6B:
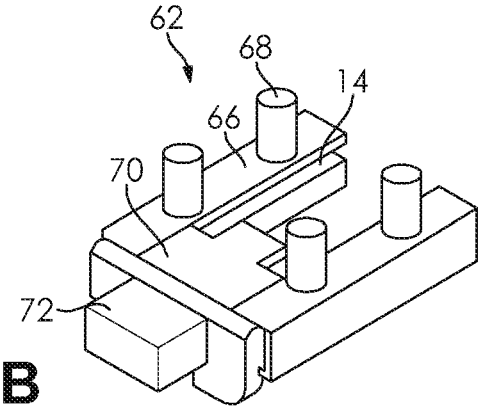
Figure 6C:
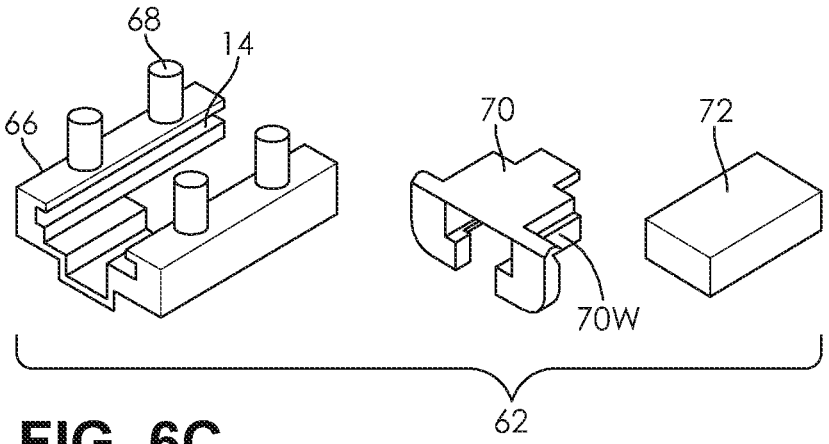
Figure 6D:
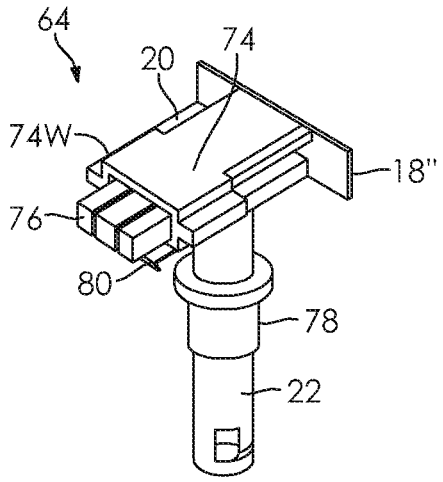
Figure 6E:
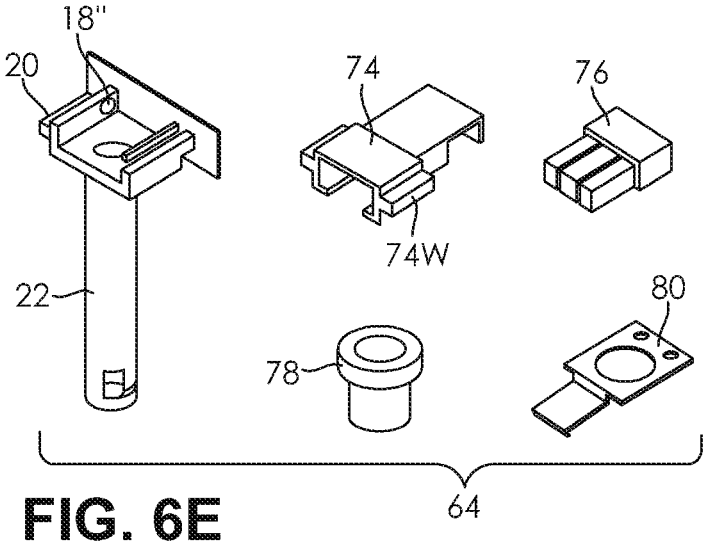

FIG. 6A is a perspective view of a feedthrough assembly 60 formed by the union of a female connector subassembly 62 as shown in FIG. 6B and a corresponding male subassembly 64 shown in FIG. 6D. Exploded views of the female connector subassembly 62 and the male connector subassembly 64 are shown in FIG. 6C and FIG. 6E, respectively. The female connector subassembly 62 has a guide rail component 66 with opposing slots 14 that are configured to engage with the male connector subassembly 64, and a series of locating pins 68, which for example may be used to position and hold the female connector subassembly 62 to a mullion or door of a refrigeration unit. In a specific embodiment the guide rail component 66 may be made of cast zinc, other metals or alloys, and composite materials. A first electrical connector holder 70 with wings 70W that may be made of insulating composites or plastic is inserted into the opposing slots 14 of the guide rail component 66. The electrical connector holder 70 holds an inserted female wire terminal 72 which is joined to a male wire terminal 76 of the male connector subassembly 64. The female wire terminal 72 and the male wire terminal 76 may be made of insulating composites or plastic. The male connector subassembly 64 has a feedthrough connector 18" with a feedthrough conduit 22 that extends outward to protect a bundle of wires 24 that terminate at the male wire terminal 76. The feedthrough connector 18" has a set of wings 20 that are configured to slide into the slots 14 of the guide rail component 66 of the female connector subassembly 62. A second electrical connector holder 74 with wings 74W that may be made of insulating composites or plastic holds the male wire terminal 76. The male wire terminal 74 extends outward from the feedthrough connector 18" for insertion via the opposing slots 14 into the female wire terminal 72 of the female connector subassembly 62. A plastic sleeve or grommet 78 mounts on the feedthrough conduit 22 to hold the feedthrough conduit 22 when inserted in a hole of a mullion or door of a refrigeration unit. The plastic sleeve or grommet 78 may serve to deaden vibration and/or prevent moisture from reaching the electrical wires and connections of the feedthrough assembly 60. Spring plate 80 locks the male wire terminal 76 to the female wire terminal 72 when inserted.

Figure 7:
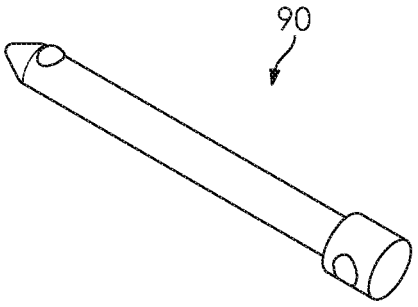
FIG. 7 is a perspective view of a pin according to an embodiment of the invention.

FIG. 7 is a perspective view of a pin 90. The pin 90 is spring loaded and adapted to retain slidably mating portions together as, for example, through engaging hole 26.

The foregoing description is illustrative of particular embodiments of the invention, but is not meant to be a limitation upon the practice thereof. The following claims, including all equivalents thereof, are intended to define the scope of the invention.

The invention claimed is:

1. A wiring feedthrough assembly comprising:

a set of parallel guide rails with slots;

a female electrical connector positioned between said guide rails;

a feedthrough connector with a male electrical connector and a set of wings configured on opposite sides of said feedthrough connector, said set of wings configured to engage and slide in said slots until said female electrical connector engages said male electrical connector;

a single spring biased locking mechanism to lock the male electrical connector to the female electrical connector; and a conduit extending outward from said feedthrough connector containing a set of wires, said set of wires terminating at said male electrical connector;

wherein one rail from said set of parallel guide rails further comprises a side clip locking engagement pin, wherein in order to engage said feedthrough connector fully in said set of parallel guide rails said clip locking engagement pin is extended away from said one rail and then said side clip locking engagement pin is allowed to retract and catches a rear edge of a wing from said set of wing in the slot; and wherein said clip locking engagement pin has an inward spring bias that cause the engagement pin to secure said feedthrough connector to said guiderails.

2. The wiring feedthrough assembly of claim 1 wherein said female electrical connector engages with said male electrical connector by a snap fit connection.

3. The wiring feedthrough assembly of claim 1 wherein said wiring feedthrough assembly is used in display units.

4. The wiring feedthrough assembly of claim 3 wherein said display unit is a refrigeration unit.

5. The wiring feedthrough assembly of claim 4 wherein said wiring feedthrough assembly connects to an electrical conduit in a mullion for delivering electrical power to an anti-condensation device for a door assembly and for a lighting fixture associated with the mullion in said refrigeration unit.

* * * * *